US008547409B2

(12) United States Patent
Yokoyama et al.

(10) Patent No.: US 8,547,409 B2
(45) Date of Patent: Oct. 1, 2013

(54) LIGHT EMISSION CONTROL DEVICE, LIGHT EMISSION CONTROL METHOD, AND IMAGE FORMING APPARATUS

(75) Inventors: Takuhei Yokoyama, Osaka (JP); Izumi Kinoshita, Hyogo (JP); Kunihiro Komai, Osaka (JP); Tatsuya Miyadera, Osaka (JP); Yoshinori Shirasaki, Osaka (JP); Takeshi Shikama, Osaka (JP); Akinori Yamaguchi, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 15 days.

(21) Appl. No.: 13/307,865

(22) Filed: Nov. 30, 2011

(65) Prior Publication Data

US 2012/0147114 A1 Jun. 14, 2012

(30) Foreign Application Priority Data

Dec. 13, 2010 (JP) ..... 2010-276843

(51) Int. Cl.
*B41J 2/435* (2006.01)

(52) U.S. Cl.
USPC ..... 347/237; 347/234; 347/235; 347/247; 347/248

(58) Field of Classification Search
USPC ..... 347/236, 237, 234–235, 247–248
See application file for complete search history.

(56) References Cited

U.S. PATENT DOCUMENTS

| | | | |
|---|---|---|---|
| 2002/0018111 A1* | 2/2002 | Ikematsu | 347/248 |
| 2010/0166444 A1 | 7/2010 | Nomura et al. | |

FOREIGN PATENT DOCUMENTS

| | | | |
|---|---|---|---|
| JP | 6-227037 | | 8/1994 |
| JP | 7-52447 | | 2/1995 |
| JP | 10-177144 | | 6/1998 |
| JP | 2000-238319 | | 9/2000 |
| JP | 2000-289251 | | 10/2000 |
| JP | 2002-277778 | | 9/2002 |
| JP | 2005-84555 | | 3/2005 |
| JP | 2005084555 | A * | 3/2005 |
| JP | 2005-189339 | | 7/2005 |
| JP | 2006-187929 | | 7/2006 |
| JP | 2006-337515 | | 12/2006 |
| JP | 2007-3862 | | 1/2007 |
| JP | 2007-38546 | | 2/2007 |
| JP | 2007038546 | A * | 2/2007 |
| JP | 2007-88928 | | 4/2007 |

(Continued)

OTHER PUBLICATIONS

Extended Search Report issued Mar. 6, 2012 in European Application No. 11191798.5.

*Primary Examiner* — Stephen Meier
*Assistant Examiner* — Sarah Al Hashimi
(74) *Attorney, Agent, or Firm* — Oblon, Spivak, McClelland, Maier & Neustadt, L.L.P.

(57) ABSTRACT

A light emission control device images an electrostatic latent image on a photosensitive element by a plurality of light emitting elements corresponding to a line in a second direction perpendicular to a first direction which is a rotational direction the photosensitive element. The light emission control device includes: a detecting unit that detects a rotational position of the photosensitive element, in the first direction, corresponding to a line in the second direction; an acquiring unit that acquires a distance between the light emitting elements and the rotational position of the photosensitive element in the first direction detected by the detecting unit; and a control unit that controls light emission by the light emitting elements according to the distance acquired by the acquiring unit and corrects a fluctuation in a density of a visible image converted from the electrostatic latent image.

10 Claims, 7 Drawing Sheets

(56) References Cited

FOREIGN PATENT DOCUMENTS

| | | |
|---|---|---|
| JP | 2007-144731 | 6/2007 |
| JP | 2008-36850 | 2/2008 |
| JP | 2009-27683 | 2/2009 |
| JP | 2009-163103 | 7/2009 |
| JP | 4428953 | 12/2009 |
| JP | 2010-8913 | 1/2010 |
| JP | 4440760 | 1/2010 |
| JP | 4462801 | 2/2010 |
| JP | 2010-217728 | 9/2010 |
| JP | 2010-217753 | 9/2010 |
| JP | 2011-59622 | 3/2011 |
| JP | 2011-68127 | 4/2011 |

* cited by examiner

LIGHT EMISSION CONTROL DEVICE, LIGHT EMISSION CONTROL METHOD, AND IMAGE FORMING APPARATUS

CROSS-REFERENCE TO RELATED APPLICATIONS

The present application claims priority to and incorporates by reference the entire contents of Japanese Patent Application No. 2010-276843 filed in Japan on Dec. 13, 2010.

BACKGROUND OF THE INVENTION

1. Field of the Invention

The present invention relates a light emission control device, a light emission control method, and an image forming apparatus.

2. Description of the Related Art

In an electrophotography image forming apparatus, due to fluctuation of the distance between a photosensitive drum (photosensitive element) and a light-emitting diode (LED) array in an optical axis direction of light, the beam spot diameter of light that the photosensitive drum receives from the LED array fluctuates accordingly. This gives rise to a problem with an electrophotography image forming apparatus, for example, when the LED array becomes tilted with respect to a photosensitive drum, the density of the image fluctuates depending on positions in the main scanning direction. Further problems with the electrophotography image forming apparatus is that, when the photosensitive drum is rotating, the distance between the photosensitive drum and the LED array in the optical axis direction of the light periodically changes due to the eccentricity of the rotating shaft of the photosensitive drum or the variation in film thickness formed on the photosensitive drum depending on positions across the photosensitive drum, which gives rise to a fluctuation in the density of an image.

In this regard, a technique which uses a member for keeping the constant distance between the photosensitive drum and the LED array in the optical axis direction of light is disclosed (see Japanese Patent Application Laid-open No. 2010-008913).

However, a problem with this approach using the member for keeping the constant distance between the photosensitive drum and the LED array in the optical axis direction of light is that it increases the cost since further study is required about how to constitute the member.

SUMMARY OF THE INVENTION

It is an object of the present invention to at least partially solve the problems in the conventional technology.

According to an aspect of the present invention a light emission control device that images an electrostatic latent image on a photosensitive element by a plurality of light emitting elements corresponding to a line in a second direction perpendicular to a first direction which is a rotation direction the photosensitive element, the device includes: a detecting unit that detects a rotational position of the photosensitive element, in the first direction, corresponding to a line in the second direction; an acquiring unit that acquires a distance between the light emitting elements and the rotational position of the photosensitive element in the first direction detected by the detecting unit; and a control unit that controls light emission by the light emitting elements according to the distance acquired by the acquiring unit and corrects a fluctuation in a density of a visible image converted from the electrostatic latent image.

According to another aspect of the present invention a light emission control method executed by a light emission control device that images an electrostatic latent image on a photosensitive element by a plurality of light emitting elements corresponding to a line in a second direction perpendicular to a first direction which is the rotation direction of the photosensitive element, the method includes: detecting a rotational position of the photosensitive element, in the first direction, corresponding to a line in the second direction; acquiring a distance between the light emitting elements and the rotational position of the photosensitive element in the first direction detected by the detecting unit, by an acquiring unit; and controlling light emission by the light emitting elements according to the distance acquired by the acquiring unit and correcting a fluctuation in a density of a visible image converted from the electrostatic latent image, by a control unit.

According to still another aspect of the present invention, an image forming apparatus includes: a photosensitive element; a light emitting unit that includes a plurality of light emitting elements corresponding to a line in a second direction perpendicular to a first direction which is a rotation direction of the photosensitive element and images an electrostatic latent image on the photosensitive element by light emission from the light emitting elements; a developing unit that converts the electrostatic latent image formed on the photosensitive element into a visible image; a detecting unit that detects a rotational position of the photosensitive element, in the first direction, corresponding to a line in the second direction; an acquiring unit that acquires a distance between the light emitting elements and the rotational position of the photosensitive element in the first direction detected by the detecting unit; and a control unit that controls light emission by the light emitting elements according to the distance acquired by the acquiring unit and corrects a fluctuation in a density of the visible image converted from the electrostatic latent image.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Preferred exemplary embodiments of an electrophotography image forming apparatus to which a light emission control device, a light emission control method, an image forming apparatus according to the present invention are applied will be described in detail with reference to the accompanying drawings.

Figure 1:
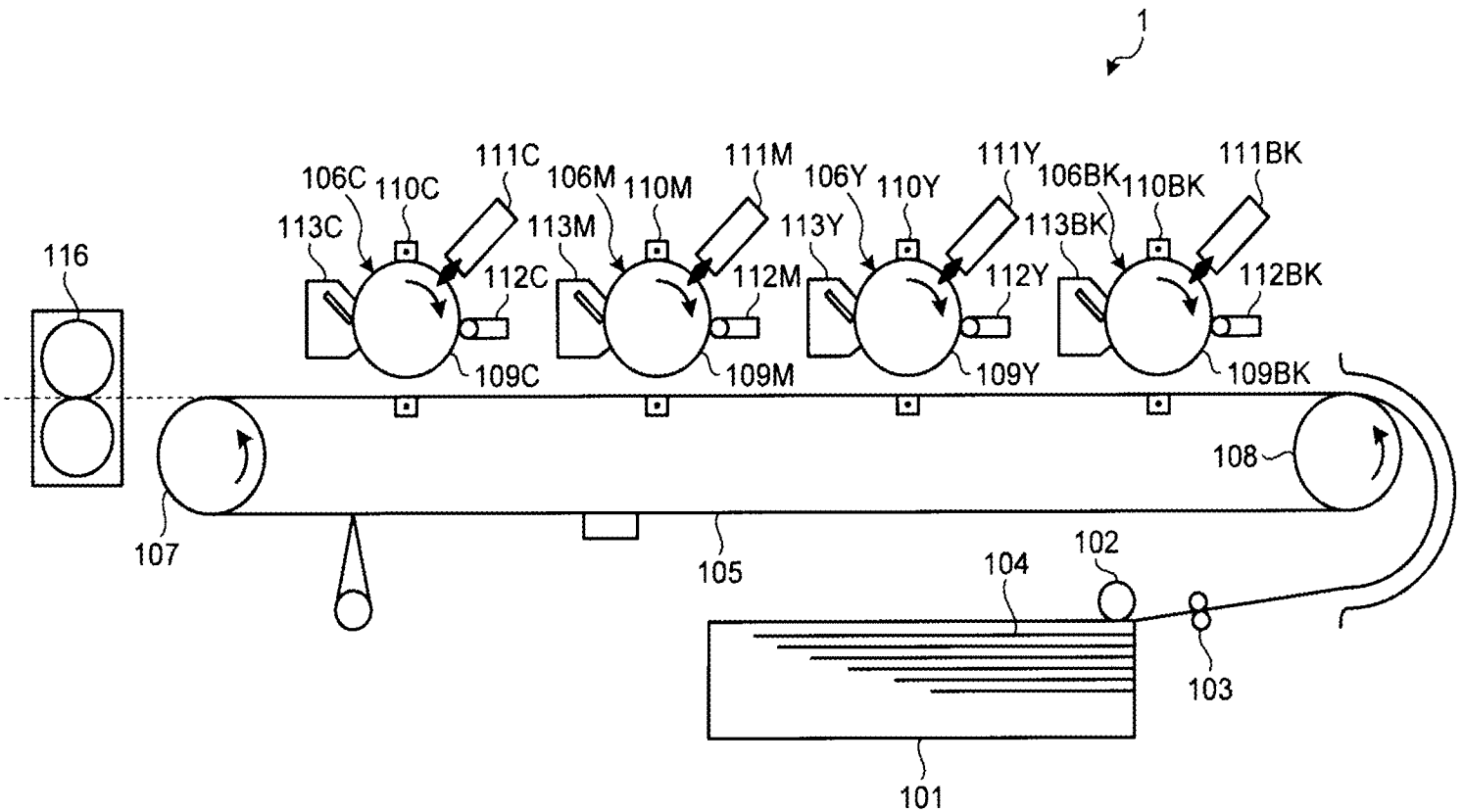
FIG. 1 is a diagram illustrating the schematic configuration of an image forming apparatus according to the present embodiment.

FIG. 1 is a diagram illustrating a schematic configuration of an image forming apparatus according to the present embodiment. An image forming apparatus 1 according to the present embodiment includes image forming units 106BK, 106Y, 106M, and 106C for C, M, Y, and K colors, respectively, which are arranged along a conveying belt 105 which is an endless moving means as illustrated in FIG. 1. The image forming apparatus 1 is of what is called a tandem type. Specifically, the image forming apparatus 1 according to the present embodiment includes a plurality of image forming units (electrophotography processing units) 106BK, 106Y, 106M, and 106C which are arranged in this order from the upstream side in a conveying direction of the conveying belt 105, along the conveying belt 105 that conveys a sheet (recording sheet) 104 which is separated one after another by a sheet feeding roller 102 and a separating roller 103 and then fed from a sheet feed tray 101.

The plurality of image forming units 106BK, 106Y, 106M, and 106C are different in the color of a toner image formed on the sheet 104 but the same in an internal configuration thereof. The image forming unit 106BK forms a black image, the image forming unit 106M forms a magenta image, the image forming unit 106C forms a cyan image, and the image forming unit 106Y forms a yellow image. Thus, the following description will be made focusing on the image forming unit 106BK. However, since the remaining image informing units 106M, 106C, and 106Y have the same components as the image forming unit 106BK, in FIG. 1, components of the image informing units 106M, 106C, and 106Y are denoted with reference numerals, which are discriminated by M, C, and Y instead of BK used to represent the components of the image forming unit 106BK, and thus the redundant description will be omitted.

The conveying belt 105 is an endless belt wounded on a driving roller 107, which is rotatably driven, and a driven roller 108. The driving roller 107 is rotatably driven by a driving motor (not shown). The driving motor, the driving roller 107, and the driven roller 108 function as a driving means for moving the conveying belt 105 which is an endless moving means.

At the time of forming an image, in the image forming apparatus 1 according to the present embodiment, the sheets 104 stored in the sheet feed tray 101 are consecutively fed from the top sheet one by one, the sheet 104 is adsorbed onto the conveying belt 105 by an electrostatic adsorption action, the sheet 104 is conveyed to the first image forming unit 106BK by the rotatably driven conveying belt 105, and a black toner image is transferred onto the sheet 104 in the image forming unit 106BK.

The image forming unit 106BK includes a photosensitive drum 109BK which is a photosensitive body rotating in a sub scanning direction (a first direction) by a driving motor (not shown), an LED array head 111BK which is a light emitting means for imaging an electrostatic latent image on the photosensitive drum 109BK with light emitted from a plurality of Light Emitting Diodes (LEDs) (light emitting drums) corresponding to a line in a main scanning direction (a second direction) perpendicular to the sub scanning direction which is a rotation direction of the photosensitive drum 109BK, a charging unit 110BK arranged around the photosensitive drum 109BK, a developing unit 112BK that converts the electrostatic latent image formed on the photosensitive drum 109BK into a visible image, a photosensitive drum cleaner (not shown), a neutralization unit 113BK, and the like. The LED array head 111BK is configured to emit light onto the photosensitive drum 109BK of the image forming unit 106BK in units of 1/n dots.

Here, a description will be made in connection with an operation of forming an image on the sheet 104 using the image forming units 106BK, 106Y, 106M, and 106C. First, at the time of forming an image, the image forming unit 106BK uniformly charges the outer circumferential surface of the photosensitive drum 109BK in the dark with the charging unit 110BK. Next, the image forming unit 106BK emits illumination light corresponding to a black image from the LED array head 111BK and forms an electrostatic latent image on the photosensitive drum 109BK. Then, the image forming unit 106BK converts the electrostatic latent image into a visible image using black toner with the developing unit 112BK, so that a black toner image is formed on the photosensitive drum 109BK. The toner image is transferred onto the sheet 104, by an action of a transfer unit (not shown), at the position (the transfer position) where the photosensitive drum 109BK comes into contact with the sheet 104 on the conveying belt 105. Through this transfer, a black toner image is formed on the sheet 104. The photosensitive drum 109BK having completed the transfer of the toner image removes unnecessary toner remaining on the outer circumferential surface with the photosensitive drum cleaner (not shown), is neutralized by the neutralization unit 113BK, and is on standby for next image formation. Thereafter, the sheet 104 onto which the black toner image has been transferred by the image forming unit 106BK is conveyed to the next image forming unit 106Y by the conveying belt 105. The image forming unit 106Y forms a yellow toner image on a photosensitive drum 109Y by the same process as the image forming process performed by the image forming unit 106BK and then transfers the yellow toner image onto the sheet 104 on which the black image is formed in a superimposed manner. The sheet 104 is further conveyed to the next image forming units 106M and 106C. By the same operation, a magenta toner image formed on a photosensitive drum 109M and a cyan toner image formed on a photosensitive drum 109C are transferred onto the sheet 104 in a superimposed manner. As a result, a full color image is formed on the sheet 104. The sheet 104 on which the full-color superimposed image is formed is peeled off the conveying belt 105, and then the image is fixed by a fixing unit 116. Thereafter, the sheet 104 is ejected from the image forming apparatus 1.

Figure 2:
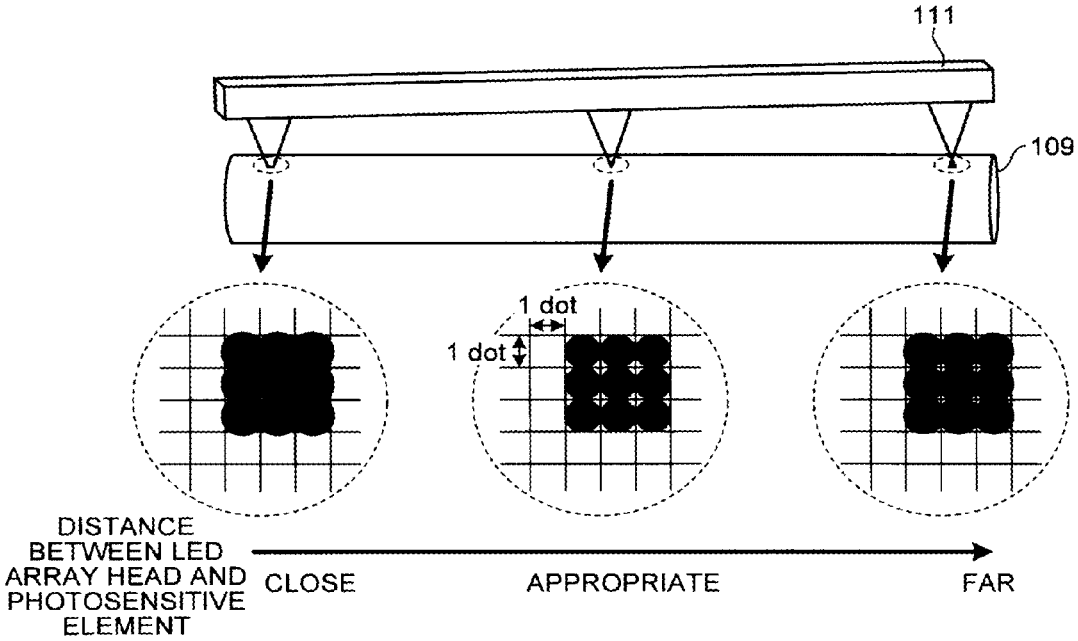
FIG. 2 is a diagram illustrating a toner image formed when an LED array head is inclined with respect to a photosensitive drum.
Figure 3:
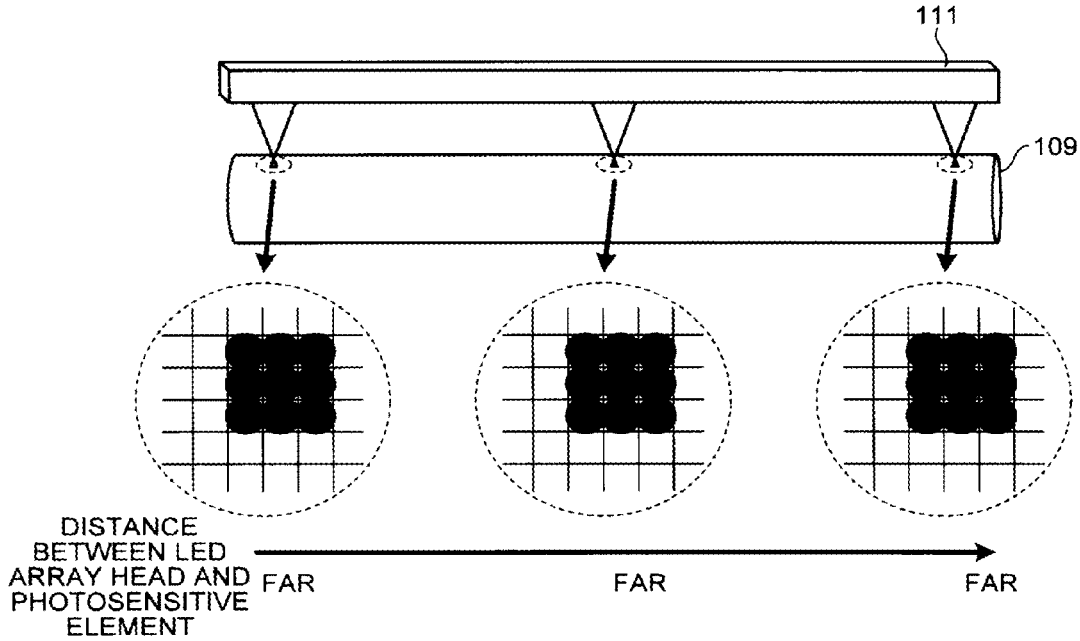
FIG. 3 is a diagram illustrating a toner image formed when an LED array head is deviated in a parallel direction with respect to a photosensitive drum.

Next, the density fluctuation occurring when the distance between LED array heads 111BK, 111Y, 111M, and 111C and the photosensitive drums 109BK, 109Y, 109M, and 109C change will be described with reference to FIGS. 2 and 3. In the following description, the LED array heads 111BK, 111Y, 111M, and 111C are collectively referred to as "LED array head 111", and the photosensitive drums 109BK, 109Y, 109M, and 109C are collectively referred to as "photosensitive drum 109". FIG. 2 is a diagram illustrating a toner image formed when the LED array head is inclined with respect to the photosensitive drum. FIG. 3 is a diagram illustrating a toner image formed when the LED array head is deviated in a parallel direction with respect to the photosensitive drum.

Generally, the LED array head 111 used as light source of the image forming units 106BK, 106Y, 106M, and 106C is disposed such that: a beam spot corresponding to one pixel can be formed; or a beam spot slightly larger than one pixel in the main scanning direction can be formed to; thereby preventing formation of a clearance gap in the main scanning direction when the distance between the LED array head 111 and the photosensitive drum 109 matches with the focal length of light emitted from the LED array head 111. In the present embodiment, it is assumed that the LED array head 111 forms the beam spot corresponding to one pixel when the distance between the LED array head 111 and the photosensitive drum 109 does not deviate from the focal length of light emitted from the LED array head 111.

However, as illustrated in FIG. 2, when the LED array head 111 is inclined with respect to the photosensitive drum 109 (that is, the distance between the LED array head 111 and the photosensitive drum 109 differs according to the position of the photosensitive drum 109 in the main scanning direction), a portion on which a beam spot larger than one pixel is formed is generated on the photosensitive drum 109. Due to the above reasons, when the electrostatic latent image formed on the photosensitive drum 109 is converted into a visible image; the amount of toner attached onto a portion on which the large beam spot is formed increases; and thus a toner image, which is thicker than a toner image which was converted into a visible image by an appropriate beam spot, is formed.

Further, as illustrated in FIG. 3, when the LED array head 111 is deviated in a parallel direction with respect to the photosensitive drum 109, a beam spot larger than one pixel is formed on the photosensitive drum 109. Due to the above reasons, when the electrostatic latent image formed on the photosensitive drum 109 is converted into a visible image; the amount of toner attached onto a portion on which the large beam spot is formed increases; and thus a thick toner image which is relatively thicker than a toner image which was converted into a visible image by an appropriate beam spot, is formed.

Consequently, the image forming apparatus 1 according to the present embodiment, the distance between the LED array head 111 and the photosensitive drum 109 in each position on the photosensitive drum 109 is stored; the light emission from the LED array head 111 is controlled according to the stored distance; and thus the density of the toner image is corrected. Specifically, the image forming apparatus 1: calculates a deviation amount between the stored distance and the focal length of light emitted from the LED array head 111; and controls light emission emitted from the LED array head 111 by reducing a driving current supplied to each of the LEDs installed in the LED array head 111 according to the calculated deviation amount.

Alternatively, when the LED array head 111 is deviated in a parallel direction with respect to the photosensitive drum 109 (see FIG. 3); the image forming apparatus 1 may correct the fluctuation in the density of the toner image by reducing a ratio of a light emission time to a line clear period during which a line clear signal is output; where the line clear signal is a signal for specifying the timing to start writing in the rotation direction of the photosensitive drum 109. Thus, for the image forming apparatus having a characteristic that the LED array head 111 is not inclined with respect to the photosensitive drum 109 but is deviated in a parallel direction with respect to the photosensitive drum 109, it is preferable to select a method of correcting the fluctuation in the density of the toner image using the ratio of the light emission time in the line clear period.

Figure 4:
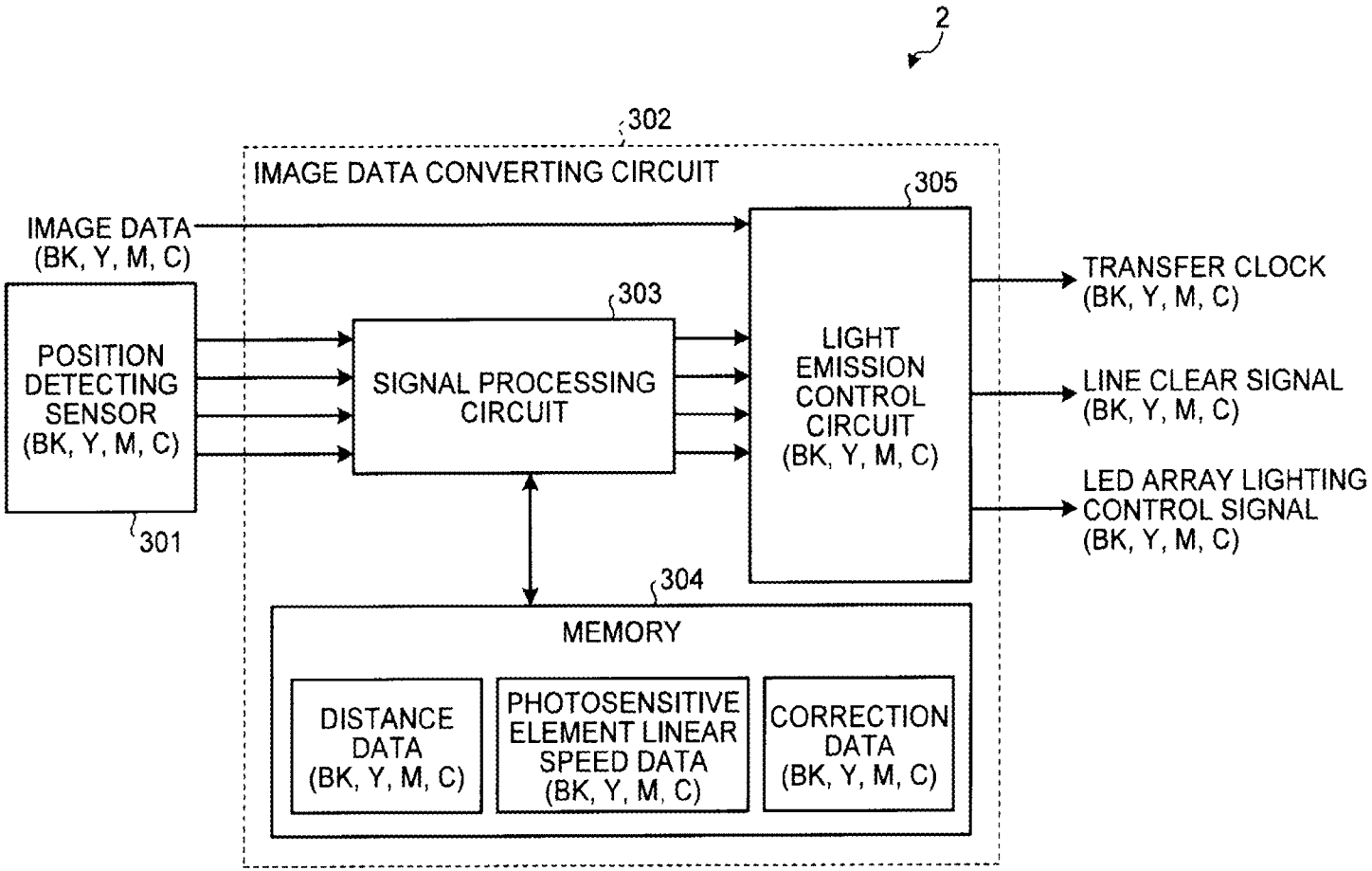
FIG. 4 is a block diagram illustrating the configuration of a light emission control device that controls light emission from an LED array head.

Next, a light emission control device that controls emission of light emitted from the LED array heads 111BK, 111Y, 111M, and 111C will be described with reference to FIG. 4. FIG. 4 is a block diagram illustrating a configuration of a light emission control device which controls the light emission emitted from the LED array head.

A light emission control device 2 includes: a position detecting sensor 301 provided for each of the photosensitive drums 109 of the respective colors of black, yellow, magenta, and cyan; and an image data converting circuit 302 to which image data of the four colors of black, yellow, magenta, and cyan are input.

The position detecting sensor 301 is arranged in the sub scanning direction along with the LED array head 111. The position detecting sensor 301 detects the rotational position of the photosensitive drum 109, in the sub-scanning direction, corresponding to a line, in the main scanning direction in which light emitted from the LED array head 111 is imaged in the optical axis direction. The distance between the LED array head 111 and the photosensitive drum 109 depends on the position on the photosensitive drum 109. For this reason, it is necessary to adjust the timing of when to control the emission of light emitted from the LED array head 111 (that is, the timing of when to start the density correction of the toner image) according to the rotational position of the photosensitive drum 109, in the sub-scanning direction, corresponding to a line, in the main scanning direction, in which light emitted from the LED array head 111 is imaged in the optical axis direction. Thus, in order to perform the density correction of the toner image, it is necessary to detect the rotational position of the photosensitive drum 109, in the sub-scanning direction, corresponding to a line, in the main scanning direction, in which light emitted from the LED array head 111 is imaged in the optical axis direction.

Figure 5:
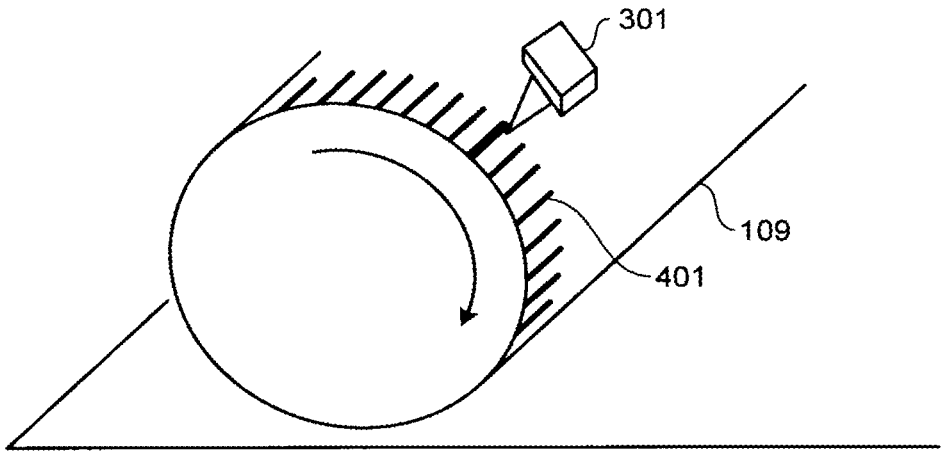
FIG. 5 is a diagram for describing a method of detecting the rotational position of a photosensitive drum, in a sub-scanning direction, corresponding to a line in a main scanning direction.

FIG. 5 is a diagram for explaining a method of detecting the rotational position of the photosensitive drum in the sub-scanning direction with respect to the line in the main scanning direction. In the image forming apparatus 1 according to the present embodiment, the photosensitive drum 109 includes a plurality of position detection marks 401 arranged, at equally-spaced intervals in the sub scanning direction, on a non-irradiated area that is an area which is not irradiated with the light emitted from the LED array head 111. The position detecting sensor 301 includes a light emitting drum and a light receiving drum. The position detecting sensor 301 detects the position detection mark 401 by irradiating the non-irradiated area on the photosensitive drum 109 with a beam emitted from the light emitting drum and receiving light reflected from the non-irradiated area of the light receiving drum.

The position detection marks 401 include a reference mark having a different feature such as wider line than other marks. By counting the number of detected marks from the reference mark, the position detection sensor 301 detects the rotational position of the photosensitive drum 109, in the sub-scanning direction, corresponding to the line, in the main scanning direction, in which light emitted from an LED installed in the LED array head 111 forms image in the optical axis direction.

When all of the position detection marks 401 arranged around the photosensitive drum 109 are detected, the position detecting sensor 301 detects the detection intervals of the marks included in the detected position detection marks 401. Then, the position detecting sensor 301 functions as a linear speed detecting unit that detects the linear speed of the photosensitive drum 109 at the rotational position of the photosensitive drum 109, in the sub-scanning direction, corresponding to the line, in the main scanning direction, in which light emitted from an LED installed in the LED array head 111 is imaged in the optical axis direction, based on the detected detection intervals of the marks.

In the present embodiment, the linear speed of the photosensitive drum 109 is detected by using the position detection marks 401 disposed in the photosensitive drum 109, but the present invention is not limited thereto. For example, an image of the same marks as the position detection marks 401 may be formed on the photosensitive drum 109, and the linear speed of the photosensitive drum 109 may be detected using the marks whose image is formed on the photosensitive drum 109. In this case, the position detecting sensor 301 stores the travel distance from the reference mark included among the position detection marks 401 whose image is formed on the photosensitive drum 109 and detects the linear speed of the photosensitive drum 109 based on the stored travel distance.

The image data converting circuit 302 includes a signal processing circuit 303, a memory 304, and a light emission control circuit 305.

The memory 304 stores distance data in which the rotational position of the photosensitive drum 109 in the sub scanning direction (the position on the photosensitive drum 109 where the position detection marks 401 are present) is associated with the distance between the rotational position of the photosensitive drum 109 in the sub scanning direction and the LED array head 111, for each of the photosensitive drums 109 of black, yellow, magenta, and cyan. In the present embodiment, the distance between the LED array head 111 and the rotational position of the photosensitive drum 109, in the sub-scanning direction, corresponding to the line, in the main scanning direction, in which light emitted from the LED installed in the LED array head 111 is imaged in the optical axis direction is measured in advance, and then the distance data in which the measured distance is associated with the rotational position of the photosensitive drum 109 in the sub scanning direction is stored in the memory 304. Specifically, the distance between the LED array head 111 and the rotational position of the photosensitive drum 109 in the sub scanning direction is measured using a jig in an adjusting process at the time of printer shipment. Here, a ruler may be used as the jig. Alternatively, the actual distance between the LED array head 111 and the rotational position of the photosensitive drum 109 in the sub scanning direction may be measured by measuring the beam diameter of light emitted from the LED array head 111 to the photosensitive drum 109 through a charged coupled device (CCD) camera and comparing the measured beam diameter with the beam diameter obtained when the distance between the LED array head 111 and the rotational position of the photosensitive drum 109 in the sub scanning direction is at the appropriate distance.

Alternatively, a distance detection pattern may be formed on the photosensitive drum 109 by irradiating the photosensitive drum 109 with light emitted from the LED, and the density difference between the density of the formed distance detection pattern and a previously set appropriate density is obtained. Then, based on the obtained density difference, the amount of deviation from the distance between the LED array head 111 and the rotational position of the photosensitive drum 109 in the sub scanning direction when the image is formed with the appropriate density is calculated. However, when the distance between the LED array head 111 and the rotational position of the photosensitive drum 109 in the sub scanning direction is obtained based on the density difference between the density of the distance detection pattern formed on the photosensitive drum 109 and the appropriate density; it is necessary to form the distance detection pattern based on the density difference, which is caused by a factor other than distance deviation, such as a fluctuation in the linear speed of the photosensitive drum 109.

Further, the memory 304 stores the photosensitive drum linear speed data in which the rotational position of the photosensitive drum 109 in the sub scanning direction (the position on the photosensitive drum 109 where the position detection marks 401 are present) is associated with the linear speed of the photosensitive drum 109 detected by the position detecting sensor 301, for each of the photosensitive drums 109 of black, yellow, magenta, and cyan.

In addition, the memory 304 stores the correction data in which the rotational position of the photosensitive drum 109 in the sub scanning direction is associated with a density correction value calculated from the distance between the LED array head 111 and the rotational position of the photosensitive drum 109, in the sub scanning direction, corresponding to the line in the main scanning direction, for each of the photosensitive drums 109 of black, yellow, magenta, and cyan. Furthermore, the memory 304 stores the correction data in which the rotational position of the photosensitive drum 109 in the sub scanning direction is associated with a density correction value calculated from the linear speed of the photosensitive drum 109 at the rotational position of the photosensitive drum 109 in the sub scanning direction, for each of the photosensitive drums 109 of black, yellow, magenta, and cyan.

Here, the density correction value refers to a value used for correcting the fluctuation in the density of the toner image caused by the deviation amount between the distance between the LED array head 111 and the rotational position of the photosensitive drum 109, in the sub scanning direction, corresponding to the line in the main scanning direction and the focal length of the LED installed in the LED array head 111 or the periodic density fluctuation that occurs due to the fluctuation in the linear speed of the photosensitive drum 109. For example, the density correction value may include an electric current value of a driving electric current supplied to the LED or the line clear period.

The signal processing circuit 303: acquires the linear speed of the photosensitive drum 109 detected by the position detecting sensor 301; stores the photosensitive drum linear speed data in which the rotational position of the photosensitive drum 109 in the sub scanning direction is associated with the acquired linear speed of the photosensitive drum 109 in the memory 304; and periodically updates the photosensitive drum linear speed data. In addition, the signal processing circuit 303: stores the distance data in which the rotational position of the photosensitive drum 109 in the sub scanning direction is associated with the distance between the previously measured rotational position of the photosensitive drum 109 in the sub scanning direction and the LED array head 111 in the memory 304; and periodically updates the distance data.

Further, the signal processing circuit 303 acquires the distance and the linear speed, which are associated with the rotational position of the photosensitive drum 109 in the sub scanning direction detected by the position detecting sensor 301, based on the distance data and the photosensitive drum linear speed data stored in the memory 304. Next, the signal processing circuit 303 calculates the density correction value based on each of the acquired distance and the linear speed. Then, the signal processing circuit 303 stores the correction data in which the rotational position of the photosensitive drum 109 in the sub scanning direction is associated with the calculated density correction value in the memory 304.

Meanwhile, the distance between the photosensitive drum 109 and the LED array head 111 changes depending on the film thickness on the photosensitive drum 109. For example, when a member (for example, a photosensitive drum cleaner) which comes into contact with the photosensitive drum 109 is provided, a film on the photosensitive drum 109 is worn out, so that the film thickness on the photosensitive drum 109 is reduced by friction. In addition, the amount of change in the film thickness on the photosensitive drum 109 depends on the frictional force between the member contacting the photosensitive drum 109 and the photosensitive drum 109 itself. The film thickness on the photosensitive drum 109 is most likely to worn out at the position in which the member contacting the photosensitive drum 109 abuts, whereas the film thickness on the photosensitive drum 109 is unlikely to reduce as it moves further apart from the position in which the member contacting the photosensitive drum 109 abuts.

Therefore, the signal processing circuit 303 updates the density correction value of the correction data stored in the memory 304 according to the travel distance of the photosensitive drum 109. More specifically, the signal processing circuit 303 calculates the amount of change in the film thickness on the photosensitive drum 109 from the initial state based on the distribution of the frictional force between the photosensitive drum 109 and the member contacting the photosensitive drum 109. Then, the signal processing circuit 303 updates the density correction value of the correction data stored in the memory 304 based on the calculated amount of change. In this way, the more appropriate density correction value can be set on the fluctuation in the density of the toner image caused by the fluctuation in the film thickness on the photosensitive drum 109.

The light emission control circuit 305 controls emission of light emitted from the LED installed in the LED array head 111 according to input image data.

When image data is input to the image data converting circuit 302 to form the toner image, the light emission control circuit 305 controls light emission emitted from the LED installed in the LED array head 111 according to the distance (the distance between the LED installed in the LED array head 111 and the rotational position of the photosensitive drum 109 in the sub scanning direction) which is acquired based on the distance data by the signal processing circuit 303. In this way, the light emission control circuit 305 corrects the fluctuation in the density of the toner image occurring due to the deviation amount between the distance between the LED installed in the LED array head 111 and the rotational position of the photosensitive drum 109 in the sub scanning direction and the focal length of the LED. In the present embodiment, the light emission control circuit 305: reads out the density correction value associated with the rotational position of the photosensitive drum 109 in the sub scanning direction detected by the position detecting sensor 301 from the correction data stored in the memory 304 through the signal processing circuit 303; and controls light emission emitted from the LED array head 111 using the read out density correction value. The density correction value is calculated based on the distance between the LED array head 111 and the rotational position of the photosensitive drum 109 in the sub scanning direction.

Figure 6:
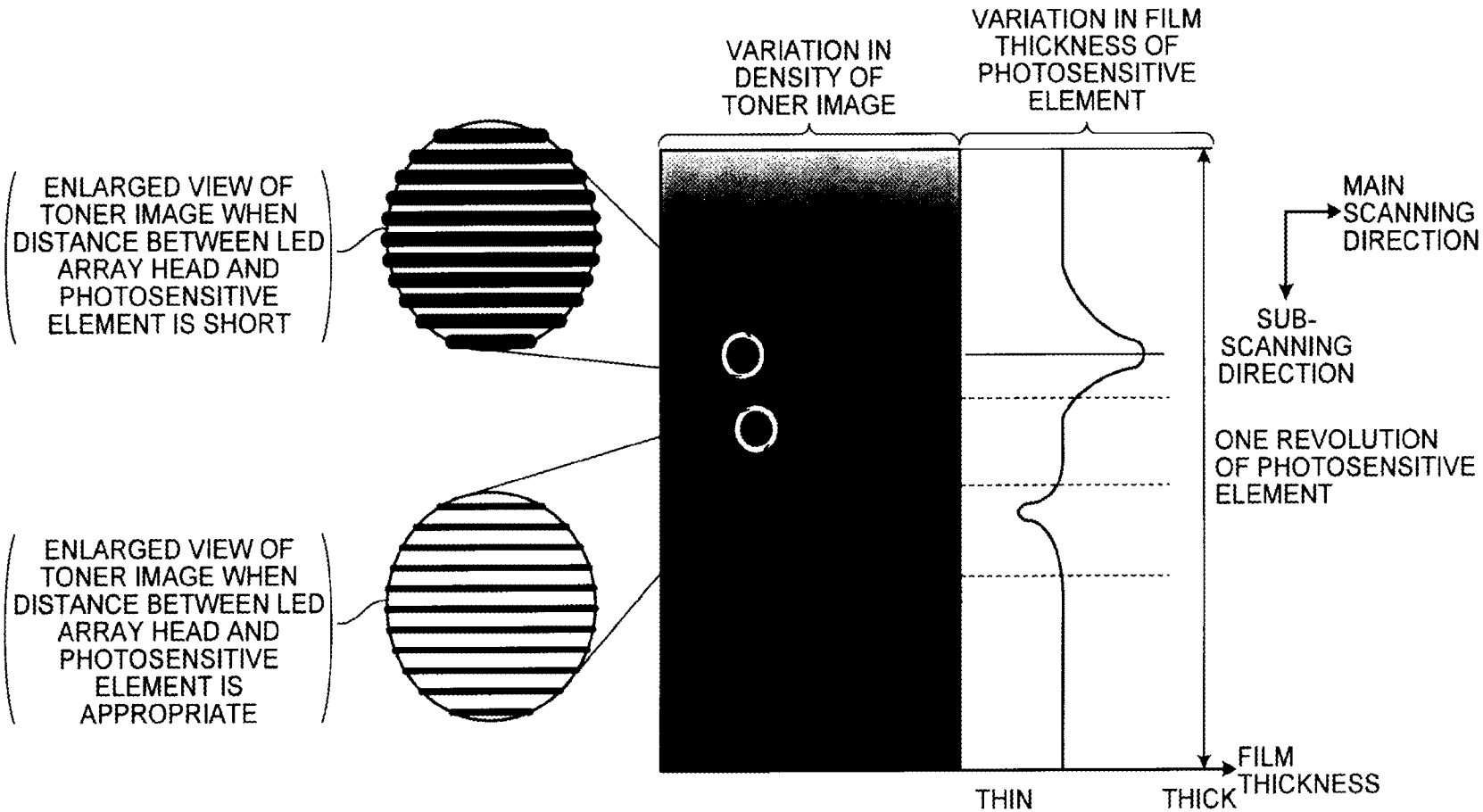
FIG. 6 is a diagram for describing an example in which a fluctuation in the density of a toner image is corrected in units of lines.

An example in which the fluctuation in the density of the toner image is corrected in units of lines will be described with reference to FIG. 6. FIG. 6 is a diagram for explaining an example in which the fluctuation in the density of the toner image is corrected in units of lines.

As described above, the distance between the photosensitive drum 109 and the LED array head 111 is varied because the photosensitive drum 109 has a thick film area and a thin film area. For this reason, the density of the toner image formed on the photosensitive drum 109 fluctuates depending on the film thickness on the photosensitive drum 109. For example, when the portion which has the thick film area is present in the photosensitive drum 109, the density of the toner image formed on the portion of the photosensitive drum 109 (a portion that is short in the distance between the photosensitive drum 109 and the LED array head 111) is thicker than the density of the toner image formed on the portion of the photosensitive drum 109 whose film thickness is appropriate (a portion that is appropriate in the distance between the photosensitive drum 109 and the LED array head 111). The fluctuation in the density of the toner image occurs in connection with the rotational period of the photosensitive drum 109.

The light emission control circuit 305 corrects the line clear period using the density correction value read from the correction data stored in the memory 304. Specifically, the light emission control circuit 305 decreases the density of the toner image by increasing the line clear period and reducing the ratio of the light emission time in the line clear period when light is emitted to the portion of the photosensitive drum 109 which causes the density of the toner image to increase. However, the light emission control circuit 305 increases the density of the toner image by shortening the line clear period and increasing the ratio of the light emission time in the line clear period when light is emitted to the portion of the photosensitive drum 109 which causes the density of the toner image to decrease.

In addition, even though the distance between the LED array head 111 and the rotational position of the photosensitive drum 109 in the sub scanning direction is constant, fluctuation in the density of the toner image may occur due to: eccentricity of the rotating shaft of the photosensitive drum 109; inclination of the LED array head 111; a fluctuation in the rotation speed of a motor that rotatably rotates the photosensitive drum 109; or the like. Even in this case, the light emission control circuit 305 corrects the density of the toner image by adjusting the line clear period.

Figure 7A:
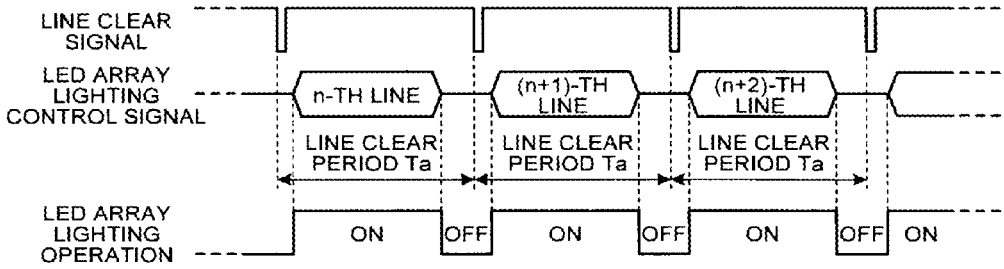
FIGS. 7A and 7B are diagrams illustrating a timing chart used for outputting a line clear signal and an LED array lighting control signal.
Figure 7B:
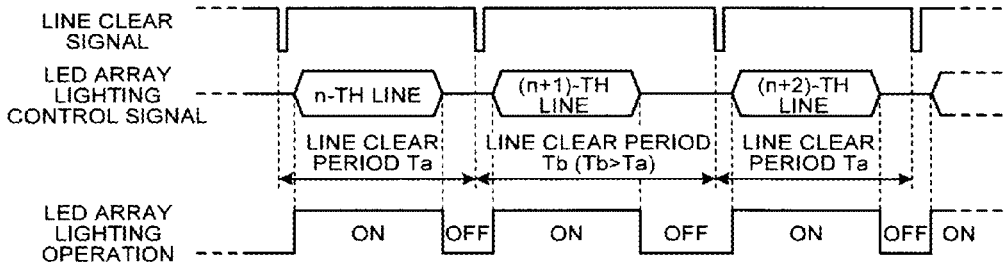

FIGS. 7A and 7B are diagrams illustrating a timing chart in which a line clear signal and an LED array lighting control signal are output. The line clear signal refers to a signal specifying the timing of when to start writing in the rotation direction of the photosensitive drum 109 as described above. The LED array lighting control signal refers to a signal for controlling the emission of light from the LED array head 111. The LED array lighting control signal includes a driving current supplied to the LED installed in the LED array head 111, a light emission time per dot (per LED), and an address of an LED to emit light among LEDs installed in the LED array head 111. When the distance between the photosensitive drum 109 and the LED array head 111 is constant, the light emission control circuit 305 outputs the line clear signal at a predetermined line clear period Ta as illustrated in FIG. 7A.

However, when the distance between the photosensitive drum 109 and the LED array head 111 is decreased in an (n+1)-th line, the light emission control circuit 305 increases the line clear period to a line clear period Tb only in the (n+1)-th line as shown in FIG. 7B. After the LED array lighting control signal is output and writing a line in the (n+1)-th line is finished, an empty time in which writing is not performed occurs, and a write position of a line in an (n+2)-th line is shifted in the sub scanning direction. By controlling the line clear period in the above described way, the density of the toner image can be controlled in the sub scanning direction, and thus it is possible to correct the fluctuation in the density of the toner image at a low cost in the sub scanning direction, which is caused by the fluctuation in the distance of light in the optical axis between the photosensitive drum 109 and the LED array head 111.

The driving current supplied to the LED installed in the LED array head 111 and the light emission time per dot are controlled by the LED array lighting control signal independently of the line clear signal. Thus, even if the fluctuation in the density of the toner image in the sub scanning direction is corrected by controlling the line clear period, it has no influence on the fluctuation in the density of the toner image in the main scanning direction. Thus, in order to correct the fluctuation in the density of the toner image in both the main scanning direction and the sub scanning direction, the light emission control circuit 305 needs to correct the fluctuation in the density of the toner image by controlling the driving current supplied to the LED installed in the LED array head 111 or correct the fluctuation in the density of the toner image in units of dots by controlling the light emission time per dot of the LED using the LED array lighting control signal. Alternatively, the fluctuation in the density of the toner image may be corrected by controlling both the line clear period during which the line clear signal is output and the light emission time of the LED by the LED array lighting control signal.

Figure 8:
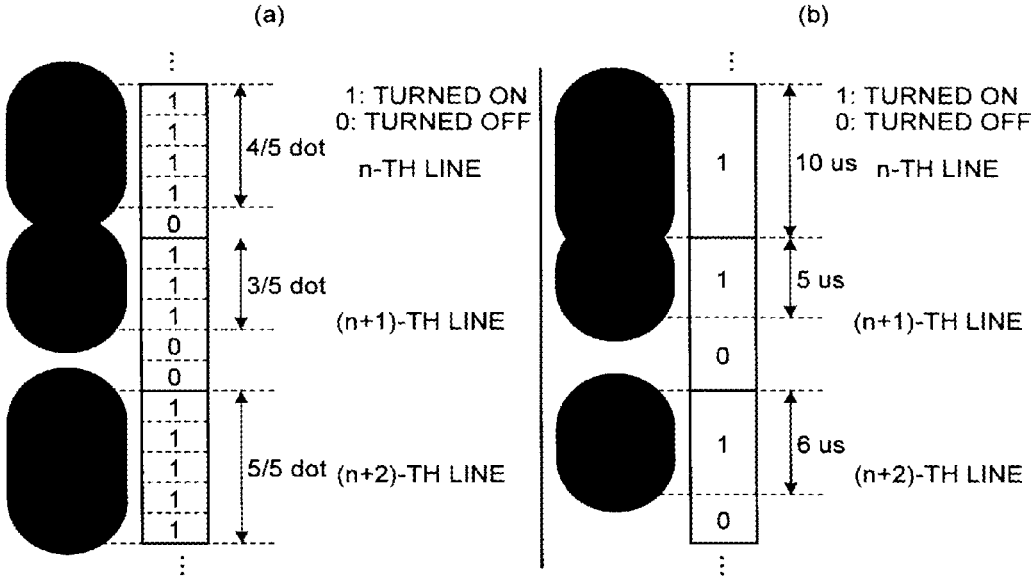
FIG. 8 is a diagram illustrating an example in which a fluctuation in the density of a toner image is corrected in units of dots.

FIG. 8 is a diagram illustrating an example in which the fluctuation in the density of the toner image is corrected in units of dots. First, a description will be made in connection with an example in which one dot is divided into 1/n dots and the fluctuation in the density of the toner image is corrected. When the distance between the photosensitive drum 109 and the LED array head 111 is decreased in an n-th line and an (n+1)-th line, the light emission control circuit 305 may correct the fluctuation in the density of the toner image by dividing one dot in the n-th line and the (n+1)-th line into 1/n dots (for example, 1/5 dots) and controlling the light emission time of light by the LED installed in the LED array head 111 such that the light emission time corresponds to m/n dots as illustrated in FIG. 8(*a*). Here, m is a positive integer less than n (m<n).

Next, a description will be made in connection with another example in which the fluctuation in the density of the toner image is corrected in units of dots. When the distance between the photosensitive drum 109 and the LED array head 111 is decreased in the (n+1)-th line and an (n+2)-th line, the light emission control circuit 305 may correct the fluctuation in the density of the toner image by controlling the light emission time for emitting light corresponding to one dot in the (n+1)-th line and the (n+2)-th line as illustrated in FIG. 8(*b*).

In addition, the light emission control circuit 305: reads the density correction value associated with the rotational position of the photosensitive drum 109 in the sub scanning direction detected by the position detecting sensor 301 from the correction data stored in the memory 304 through the signal processing circuit 303; and controls light emission performed by the LED array head 111 using the read density correction value. The density correction value is calculated based on the linear speed of the photosensitive drum 109. In the present embodiment, by controlling the line clear period based on the density correction value read out from the correction data stored in the memory 304, the light emission control circuit 305 corrects the periodic density fluctuation occurring due to the fluctuation in the linear speed of the photosensitive drum 109.

When the periodic density fluctuation occurring due to the fluctuation in the linear speed of the photosensitive drum 109 is corrected: the light emission control circuit 305 corrects light emission from the LED array head 111 using the density correction value calculated based on the linear speed of the photosensitive drum 109; and then further corrects light emission from the LED array head 111 using the density correction value calculated based on the distance between each position on the photosensitive drum 109 and the LED array head 111.

Figure 9:
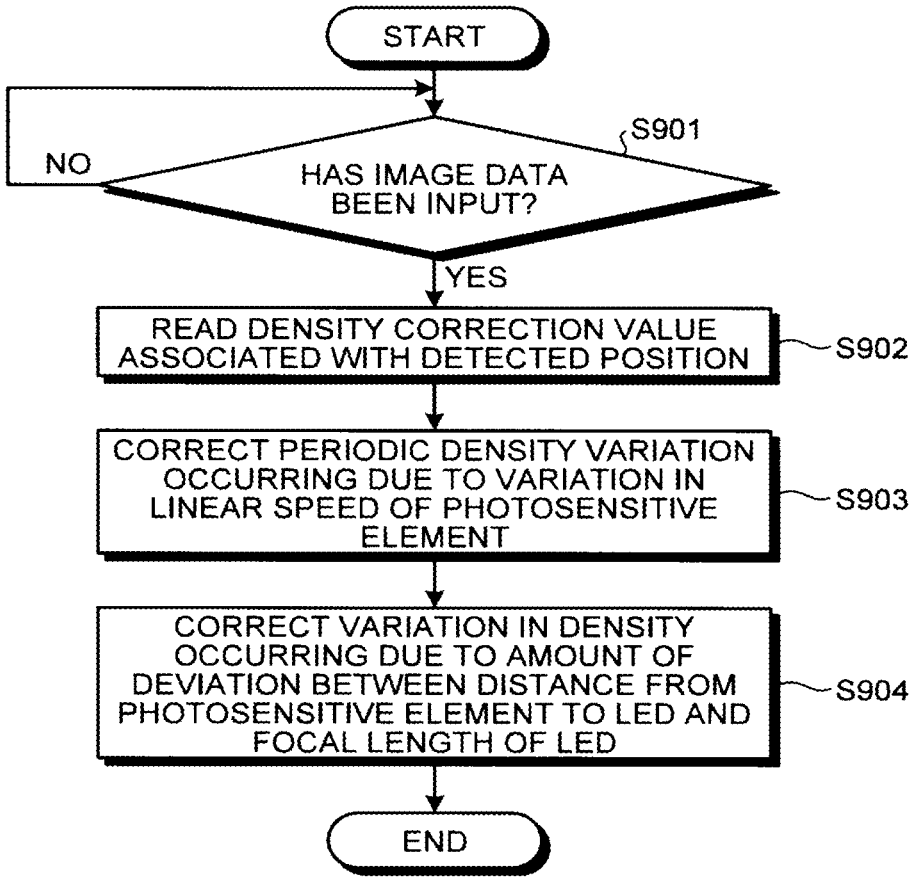
FIG. 9 is a flowchart illustrating a process of correcting a fluctuation in the density of the toner image.

FIG. 9 is a flowchart illustrating the flow of a process of correcting the fluctuation in the density of the toner image. When image data is input (Yes in step S901), in step S902, the light emission control circuit 305 reads out the density correction values associated with the rotational position of the photosensitive drum 109 in the sub scanning direction detected by the position detecting sensor 301 from the correction data stored in the memory 304 through the signal processing circuit 303 The density correction value is calculated based on the linear speed of the photosensitive drum 109 and the density correction value calculated based on the distance between the LED array head 111 and the rotational position of the photosensitive drum 109 in the sub scanning direction.

Subsequently, in step S903, the light emission control circuit 305: controls the light emission from the LED installed in the LED array head 111 using the density correction value calculated based on the linear speed of the photosensitive drum 109; and corrects the period density fluctuation in the sub scanning direction occurring due to the fluctuation in the linear speed of the photosensitive drum 109. After correcting the period density fluctuation in the sub scanning direction occurring due to the fluctuation in the linear speed of the photosensitive drum 109, in step S904, the light emission control circuit 305 corrects the fluctuation in the density caused by the deviation amount between the distance between the LED installed in the LED array head 111 and the rotational position of the photosensitive drum 109 in the sub scanning direction and the focal length of the LED using the density correction value calculated based on the distance between the LED installed in the LED array head 111 and the rotational position of the photosensitive drum 109 in the sub scanning direction.

As described above, according to the image forming apparatus 1 of the present embodiment, detected is the rotational position of the photosensitive drum 109, in the sub-scanning direction, corresponding to the line, in the main scanning direction, in which light emitted from the LED installed in the LED array head 111 is imaged in the optical axis direction. Then, acquired is the distance between the LED and the detected rotational position of the photosensitive drum 109 in the sub scanning direction. Then, the light emission by the LED is controlled according to the acquired distance, and the fluctuation in the density of a visible image converted from the electrostatic image is corrected. Thus, the fluctuation in the density of the toner image can be corrected without using the member that makes the distance of light in the optical axis between the rotational position of the photosensitive drum 109 in the sub scanning direction and the LED array head 111 constant or without controlling the position of the LED array head 111 according to the fluctuation in the film thickness on the photosensitive drum 109. Thus, the fluctuation in the density of the toner image, which is caused by the fluctuation in the distance of light in the optical axis between the photosensitive drum 109 and the LED array head 111, can be corrected at a low cost.

A program executed by the image forming apparatus 1 according to the present embodiment may be embedded in a read only memory (ROM) or the like in advance. A program executed by the image forming apparatus 1 according to the present embodiment may be a file having an installable format or an executable format and may be configured to be provided in the form recorded in a computer readable recording medium such as a compact disc-read only memory (CD-ROM), a flexible disk (FD), a compact disc-recordable (CD-R), or a digital versatile disk (DVD).

In addition, a program executed by the image forming apparatus 1 according to the present embodiment may be configured to be stored in a computer connected to a network such as the Internet and provided by downloading the program via the network. Further, a program executed by the image forming apparatus 1 according to the present embodiment may be configured to be provided or distributed via a network such as the Internet.

A program executed by the image forming apparatus 1 according to the present embodiment may have a module configuration including a position detecting unit corresponding to the position detecting sensor 301, a signal processing unit corresponding to the signal processing circuit 303, a light emission control unit corresponding to the light emission control circuit 305, and the like. In actual hardware, by reading and executing the program from the ROM through a central processing unit (CPU) that is a control unit, the above units are loaded onto a main storage device, and the position detecting unit, the signal processing unit, the light emission control unit, and the like are generated on the main storage device.

The image forming apparatus according to the above described embodiment may be applied to a multi-function peripheral (MFP) having at least two of the following; a copying function, a printer function, a scanner function, and a facsimile function, a copying machine, a printer, a scanner device, a facsimile device, and the like.

According to the present invention, there is an effect capable of correcting, at a low cost, the fluctuation in the density of an image resulting from the fluctuation in the distance between the photosensitive drum and the LED array in the optical axis direction of the light.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A light emission control device that images an electrostatic latent image on a photosensitive element by a plurality of light emitting elements corresponding to a line in a second direction perpendicular to a first direction which is a rotation direction the photosensitive element, the device comprising:

a detecting unit that detects a rotational position of the photosensitive element, in the first direction, corresponding to a line in the second direction;

an acquiring unit that acquires a distance between the light emitting elements and the rotational position of the photosensitive element in the first direction detected by the detecting unit; and a control unit that controls light emission by the light emitting elements according to the distance acquired by the acquiring unit and corrects a fluctuation in a density of a visible image converted from the electrostatic latent image, wherein:

the light emitting elements emit light according to a line clear signal specifying timing of when to start writing in the rotation direction of the photosensitive element, and the control unit corrects the fluctuation in the density of the image by controlling a line clear period during which the line clear signal is output according to the distance acquired by the acquiring unit.

2. The light emission control device according to claim 1, wherein the control unit corrects the fluctuation in the density of the image by controlling a ratio of a light emission time in the line clear period.

3. The light emission control device according to claim 1, wherein the control unit corrects the fluctuation in the density of the image by controlling light emission by the light emitting elements in units of 1/n dots.

4. The light emission control device according to claim 1, wherein the control unit corrects the fluctuation in the density of the image by controlling a driving current supplied to the light emitting elements.

5. The light emission control device according to claim 1, further comprising a measuring unit that measures a linear speed of the photosensitive element at the rotational position of the photosensitive element in the first direction detected by the detecting unit, wherein the control unit corrects a period density fluctuation of the image in the second direction by controlling light emission by the light emitting elements according to the linear speed of the photosensitive element measured by the measuring unit.

6. The light emission control device according to claim 1, further comprising a storage unit that stores the rotational position of the photosensitive element in the first direction and a density correction value which is used for correcting a period density fluctuation of the image in the first direction and is obtained based on the linear speed of the photosensitive element in association with each other, wherein the control unit controls light emission by the light emitting elements using the density correction value stored in association with the rotational position of the photosensitive element in the first direction detected by the detecting unit.

7. The light emission control device according to claim 6, wherein the control unit controls light emission by the light emitting elements using the density correction value and then further controls light emission by the light emitting elements according to the distance acquired by the acquiring unit.

8. The light emission control device according to claim 6, further comprising an updating unit that updates the density correction value stored in the storage unit according to a travel distance of the photosensitive element.

9. A light emission control method executed by a light emission control device that images an electrostatic latent image on a photosensitive element by a plurality of light emitting elements corresponding to a line in a second direction perpendicular to a first direction which is the rotation direction of the photosensitive element, the method comprising:

detecting a rotational position of the photosensitive element, in the first direction, corresponding to a line in the second direction;

acquiring a distance between the light emitting elements and the rotational position of the photosensitive element in the first direction detected by the detecting; and controlling light emission by the light emitting elements according to the distance acquired and correcting a fluctuation in density of a visible image converted from the electrostatic latent image, wherein:

the controlling light emission controls the light emission such that the light emitting elements emit light according to a line clear signal specifying timing of when to start writing in the rotation direction of the photosensitive element, and the correcting the fluctuation corrects the fluctuation in the density of the image by controlling a line clear period during which the line clear signal is output according to the distance acquired.

10. An image forming apparatus, comprising:

a photosensitive element;

a light emitting unit that includes a plurality of light emitting elements corresponding to a line in a second direction perpendicular to a first direction which is a rotation direction of the photosensitive element and images an electrostatic latent image on the photosensitive element by light emission from the light emitting elements;

a developing unit that converts the electrostatic latent image formed on the photosensitive element into a visible image;

a detecting unit that detects a rotational position of the photosensitive element, in the first direction, corresponding to a line in the second direction;

an acquiring unit that acquires a distance between the light emitting elements and the rotational position of the photosensitive element in the first direction detected by the detecting unit; and a control unit that controls light emission by the light emitting elements according to the distance acquired by the acquiring unit and corrects a fluctuation in a density of the visible image converted from the electrostatic latent image, wherein:

the light emitting elements emit light according to a line clear signal of to start writing in the rotation direction of the photosensitive element, and the control unit corrects the fluctuation in the density of the image by controlling a line clear period during which the line clear signal is output according to the distance acquired by the acquiring unit.

* * * * *